US005303484A

United States Patent [19]

Hagen et al.

[11] Patent Number: 5,303,484

[45] Date of Patent: Apr. 19, 1994

[54] COMPACT CONVECTIVE WEB DRYER

[75] Inventors: Kenneth G. Hagen, Cape Elizabeth, Me.; David A. Leeman, Worcester, Mass.

[73] Assignee: Thermo Electron Web Systems, Inc., Auburn, Mass.

[21] Appl. No.: 866,150

[22] Filed: Apr. 9, 1992

[51] Int. Cl.[5] ..... F26B 13/00

[52] U.S. Cl. ..... 34/155; 34/23; 34/156

[58] Field of Search ..... 34/155, 156, 151, 152, 34/22, 23, 160; 226/97

[56] References Cited

U.S. PATENT DOCUMENTS

| | | | |
|---|---|---|---|
| 2,772,486 | 12/1956 | Johanson | 34/159 |
| 3,308,556 | 3/1967 | Franklin et al. | 34/207 |
| 3,319,353 | 5/1967 | Matsunami et al. | 34/155 |
| 4,085,522 | 4/1978 | Stroszynski | 34/155 |
| 4,227,317 | 10/1980 | Fleissner | 34/155 |
| 4,295,284 | 10/1981 | Witkin | 34/158 |
| 4,425,719 | 1/1984 | Klein et al. | 34/155 |
| 4,435,909 | 3/1984 | Williamson, Jr. | 34/155 |
| 4,989,348 | 2/1991 | Vits | 34/155 |
| 5,112,220 | 5/1992 | Wimberger et al. | 34/155 |

FOREIGN PATENT DOCUMENTS

| | | |
|---|---|---|
| 0346042 | 12/1989 | European Pat. Off. . |
| 2391437 | 12/1978 | France . |

*Primary Examiner*—Henry A. Bennet
*Assistant Examiner*—Denise L. Gromada
*Attorney, Agent, or Firm*—Samuels, Gauthier & Stevens

[57] ABSTRACT

A convective dryer for drying a moving coated web has at least one module arranged on one side of the path of web travel. The module includes a housing subdivided into a first chamber opening towards the path of web travel and a second adjacent enclosed chamber. Mutually spaced nozzle assemblies extend laterally across the path of web travel within the first chamber. The nozzle assemblies are connected by a supply duct to air heating and recirculating components in the second chamber. The supply duct gradually diverges in width from a narrow inlet section communicating with the second chamber to a widened delivery end communicating with the nozzle assemblies at the approximate center of the path of web travel.

24 Claims, 6 Drawing Sheets

COMPACT CONVECTIVE WEB DRYER

FIELD OF THE INVENTION

This invention relates generally to systems for the convective drying of web materials, and is concerned in particular with the provision of an improved flotation dryer for use in such systems.

DESCRIPTION OF THE PRIOR ART

Convective drying has been used for several decades to augment the drying of paper, particularly tissue and coated paper. For paper coatings, flotation dryers have evolved in which the web is supported on a cushion of the drying air as it passes through the drying oven. Contact between the web and the drying components is thus avoided until the coating is sufficiently dry to prevent "picking" on subsequent carrier rolls and drying cylinders. Flotation dryers also provide an unrestricted simultaneous flow of heat to both surfaces of the web, which favors high intensity drying where appropriate.

A conventional flotation dryer installation is depicted somewhat schematically at 10 in FIG. 1. The dryer includes upper and lower modules 10*a* and 10*b* located on opposite sides of a web "W" passing therebetween. Except for an unimportant rearrangement of internal components, the dryer modules 10*a*, 10*b* are essentially mirror images of each other. Thus, the description will continue with reference primarily to the internal components of upper module 10*a*.

Drying is accomplished by an array of nozzles indicated typically at 12 positioned on each side of the web. Heated air is transported to the nozzles by a system of parallel headers 14 to which the air is directed by a supply duct 16. A similar return duct 18 collects the air after it has exited from the nozzles in the vicinity of the web.

For reasons of energy economy, a large fraction of the drying air collected by the return duct 18 is recirculated by a fan 30 through a heat source 20 via a system of external ducts 22, 26 and 28, with a smaller fraction of the air being exhausted via duct 32 to the atmosphere by an exhaust fan 34. In order to achieve even flow distribution from the nozzles, which is a prerequisite for good drying uniformity and stable web support, the system of headers and the internal supply and return ducts are necessarily large and cumbersome, as are the heat source and the external ducts. It will be seen, therefore, that a large portion of the initial cost of a convective dryer may be attributed to the air supply and return systems. The overall system configuration is severely constrained by these air handling requirements. In addition, the need for space to house these dryers is obviously substantial, due again in large part to the external ducting associated with the recirculation system.

Integration of the external ducting system into a paper mill facility can be very complex, particularly where there are several separate zones of convective drying involved. Ducting systems are often long and convoluted with large internal volumes and pressure drops. Pressure drops add to the supply fan pressure rating and power consumption. The volume lengthens the purge time required for burner starts.

It is common practice to use a bypass duct 36 and control dampers 38 to allow the air system to remain operating on a standby basis during web breaks or other interruptions of the coating operation. Balancing dampers 40 for the dryer halves above and below the web are used to adjust the position of the web between the nozzles and also to provide a measure of drying control on each of its faces. An exhaust damper 42 in duct, in conjunction with make-up air damper 44 on the burner chamber, is used to control the pressure within the dryer housing and can also enable a range of humidity control which permits adjustment of the web temperature during drying. Because of the practicalities of system installation in such typical facilities, it is difficult to provide ready access to all of these dampers. Thus, they are either fitted with remote operators which adds to the initial cost of the installation, or the dampers are simply neglected, which discards opportunities to optimize performance.

To provide access to the dryer interior for clean-up after a web break, a retraction system is usually provided to open one of the dryer modules in relation to the other. In the arrangement shown in FIG. 1, the retraction system includes pneumatic cylinders 46 positioned at the four corners of the dryer to elevate the upper dryer module 10*a*.

To maintain continuity of the exterior air ducts during such retraction procedures, they are provided at appropriate locations with flexible connectors 48 at their entry points into the retractable dryer module 10*a*. These connectors tend to deteriorate with time, and the resulting leakage impairs dryer performance. Moreover, the debris from the slow physical disintegration of the flexible connectors tends to be circulated into the nozzles, thereby gradually restricting nozzle flow. This debris is difficult to remove,, and thus can significantly increase maintenance costs. The alternative of corrugated metal flexible connectors is again a significant addition to initial installation costs.

Drying of webs in these conventional dryers is influenced by the air velocity, its temperature and its humidity. Webs are often coated and therefore wet on one side only. In such cases it is desirable to have some flexibility in the drying parameters used on the wet (coated) and dry (uncoated) faces. However, in conventional systems of the type depicted in FIG. 1, both sides of the web are dried with air from the same heat source 20. Thus, the drying air is at the same temperature and humidity. While velocities on either side of the web can be made different by means of balancing dampers, this is the least important of the control parameters. It would be far preferable to employ different temperatures and humidities on either face of the web. However, in conventional systems, this would require two air systems which would further complicate the external equipment and dramatically increase its costs as well as further complicating installation problems.

In light of the foregoing, it is a principal object of the present invention to provide an improved convective dryer configuration, particularly for wide applications, which enables the air system to be incorporated into a compact package within each of the drying halves that surround the web.

A further object of the present invention is to minimize the number of dampers needed to provide comprehensive control of the dryer.

A still further object of the present invention is to eliminate the need for flexible connectors in the ducting system used to transport the drying air.

A further objective of the present invention is to provide an economically practical use of separate air systems above and below the web, thereby maximizing drying control flexibility for the benefit of product quality and production speed.

Other objectives of the present invention include the improvement of drying performance in terms of flow and heat transfer uniformity applied to the web, as well as better energy and power consumption efficiencies.

SUMMARY OF THE INVENTION

The convective dryer of the present invention integrates a separate and independently operable air system into each of the dryer modules located on opposite sides of the web. The inter-connecting air flow passageways within each dryer module are extremely compact and designed to provide careful air management with minimum pressure losses, tight and efficient turns and short low distances. A supply fan is internal to each dryer module with the fan drive cantilevered from the drive side of the dryer. Velocity and supply balance controls are achieved with a variable speed fan drive as opposed to the conventional use of dampers. The preferred heat source is a line-type burner which provides good mixing in a small space with a very short flame, thereby allowing the burner chamber to be integral with the supply duct, the latter defusing the heated air to the cross-machine center of each module along much of the machine direction length. Heated air is transmitted to the nozzle orifices via doubly tapered manifolds which provide good cross-direction uniformity, while eliminating the requirement for intermediate headers. Return flow is again in tapered passageways between the manifolds and is led to the inlet of the supply fan at the drive side of each module. No flexible connections are employed in the ducting used to recirculate air flow. Surfaces between air streams at different temperatures are insulated to prevent shunt losses. Exhaust connections, make-up air and burner controls also are integrally mounted on the drive side of each dryer module along with the supply fan drive.

DETAILED DESCRIPTION OF PREFERRED EMBODIMENT

Figure 1:
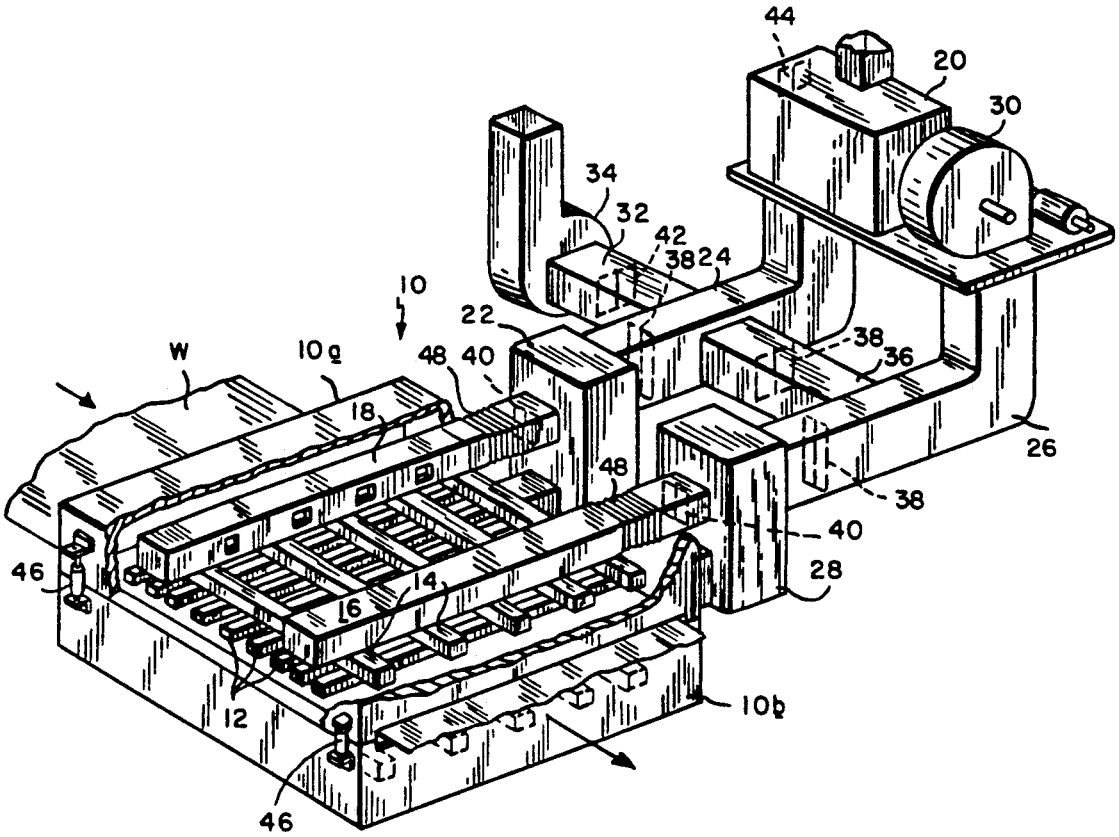
FIG. 1 PRIOR ART
FIG. 1 is a perspective view, with portions broken away, of a conventional prior art convective dryer.

Referring now to FIGS. 2–11, a preferred embodiment of a convective dryer in accordance with the present invention is shown at 52. The dryer includes at least one equipment module 54*a* arranged on one side of the path "P" of a moving Web "W". Preferably, the dryer includes an additional mating equipment module 54*b* on the opposite side of the path P. Except for an unimportant rearrangement of internal components, each of the modules 54*a*, 54*b* are essentially identical, and thus the remaining description will focus primarily on the upper module 54*a*, with the understanding that the same description would be applicable to lower module 54*b*.

Module 54*a* includes an insulated housing having front and back walls 56, 58 interconnected by side walls 60, 62 and closed by a top wall 64. The bottom of the housing opens towards the web path P. Cross-machine stiffeners 66 are located at the junctions of the top wall 64 with the side walls 60, 62. The stiffeners impart flexural and torsional rigidity to the open-bottomed housing structure.

An inner housing partition 68 extends in parallel relationship to the back wall 58 and serves to interiorly subdivide the housing into first and second chambers A, B. The first chamber A faces and opens towards the web path P. The second chamber B extends laterally beyond path P, with its bottom being closed by a bottom wall 70.

A supply duct 72 extends from the second chamber B into the first chamber A. Duct 72 has a relatively narrow entry section defining a burner chamber 72*a* extending through the partition 68, a diverging intermediate section 72*b*, and a relatively wide delivery end 72*c* located approximately at the center of both the first chamber A and the path P of web travel.

Figure 8:
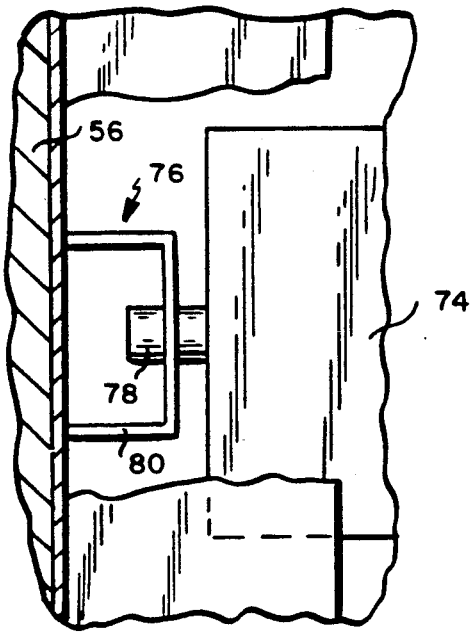
FIG. 8 is a sectional view on an enlarged scale taken along line 8—8 of FIG. 4.

Nozzle assemblies 74 extend laterally across the path P within the first housing chamber A. The nozzle assemblies are typically mounted to the housing front wall 56 and to the inner partition 68 by means of pin and bracket assemblies 76 which allow for differential thermal expansion. One such assembly 76 is depicted in FIG. 8 as including a pin 78 protruding from an end of a respective nozzle assembly 74. The pin 78 is slidable received in a hole in a U-shaped support bracket 80 secured to the adjacent housing wall 56. This arrangement accommodates thermal expansion and contraction of the nozzle assemblies in relation to the overall housing structure.

Figure 9:
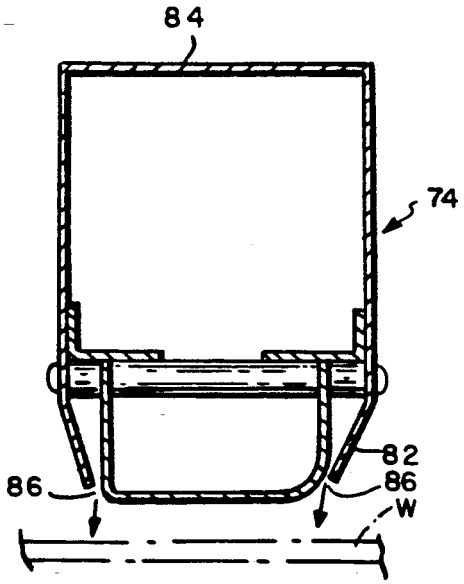
FIG. 9 is a sectional view on an enlarged scale taken along line 9—9 of FIG. 4.

Each nozzle assembly 74 consists of a lower air bar portion 82 located directly adjacent to the web path P, and an upper manifold section 84. As shown in FIG. 9, the air bar portion 82 defines a pair of slot-like orifices 86 communicating with the interior of the manifold section 84. Each manifold 84 section tapers in cross-sectional area in opposite directions from a maximum at its center to a minimum at its ends. The center of each manifold section is attached to the delivery end 72*c* of the supply duct 72 and is in communication with the interior of the supply duct via an inlet port 88.

Preferably, the supply duct 72 is provided internally with first diffusing means comprising a plurality of angularly arranged mutually spaced baffles 90 defining divergent flow paths leading to the inlet ports 88 of the manifold sections 84. The baffles 90 serve to enhance the uniformity of air distribution flowing through the supply duct 72 to the orifices 86 via the inlet ports 88. The baffles 90 also serve to maintain the structural integrity of the supply duct 72.

Preferably, the manifold sections 84 further include internal second diffusing means in the form of perforated V-shaped baffles 92 centrally located adjacent to the entry ports 88. The perforated baffles 92 act as turning vanes to further enhance uniformity of air flow to the orifices 86.

Insulated return ducts 94 are interposed between the nozzle assemblies 74. As can best be seen in FIG. 10, each return duct 94 includes doubly tapered insulated side walls 96 matching the double taper of the nozzle assemblies. The ducts 94 have perforated bottom walls 98, and insulated top walls 100, the central portions of which are connected to and extending beneath the delivery end 72*c* of supply duct 72. Outlet ports 102 are arranged in the top wall 100 of each duct 94 on opposite sides of the delivery end 72*c* of the supply duct.

Sealing plates 104, 106 extend respectively from the housing front wall 56 and the inner partition 68 to overlap the sloping top surfaces of the nozzle assemblies 74 and return ducts 94 interposed therebetween. The sealing plates 104, 106 cooperate with the nozzle assemblies 74 and return ducts 94 to form a return plenum 108 in the upper portion of housing chamber A.

Figure 4:
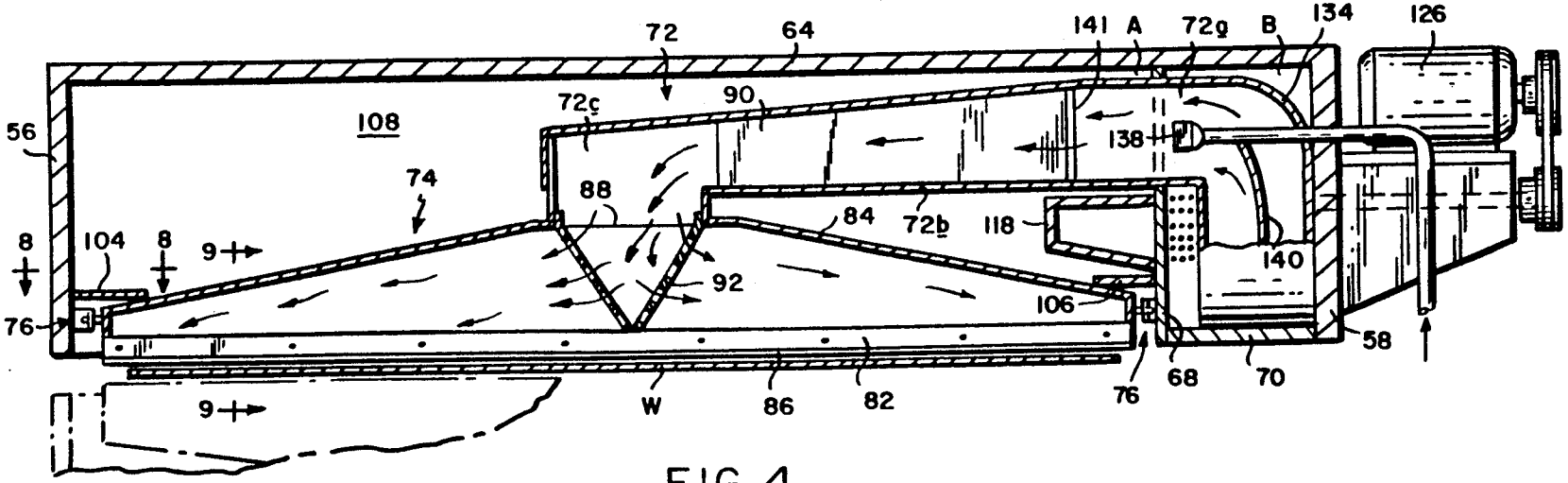
Figure 6:
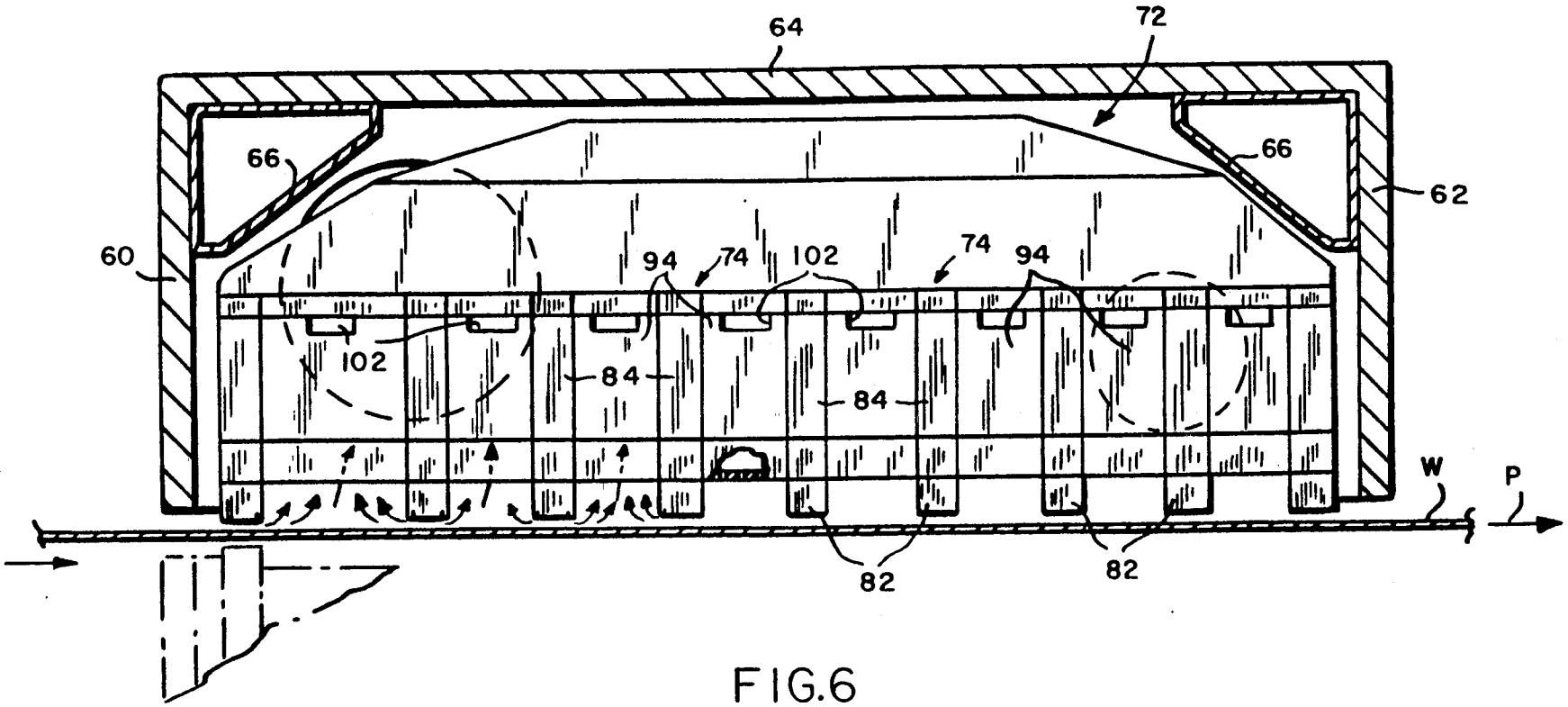

Drying air flows through the supply duct 72 in the direction schematically depicted in FIG. 4 where it is distributed by the baffles 92 to the inlet ports 88 of the nozzle assemblies 74. The drying air enters each nozzle assembly via its inlet port, and is then diffused by the perforated baffles 92 for even distribution to the orifices 86. After leaving the nozzles orifices 86, the drying air flows adjacent to the web W, and then leaves the vicinity of the web to enter the return ducts 94 via their perforated bottom walls 88. The drying air then flows through the return ducts 94 to exit via their outlet ports 102 into the return plenum 108.

A supply fan inlet port 110 and an exhaust port 112 are provided in the partition 68. Inlet port 110 is connected to a centrifugal fan 114 by a short perforated duct 116. Both the perforated duct 116 and the fan 114 are located in the second chamber B.

An internal exhaust duct 118 extends from the vicinity of the inlet port 110 to the housing side wall 62 and leads to the exhaust port 112. The exhaust port is connected to centrifugal exhaust fan 122 which in turn is connected to an exhaust duct 124. Variable speed drive motors 126, 128 for the supply fan 114 and exhaust fan 122 are cantilevered off of the back housing wall 58.

Figure 7:
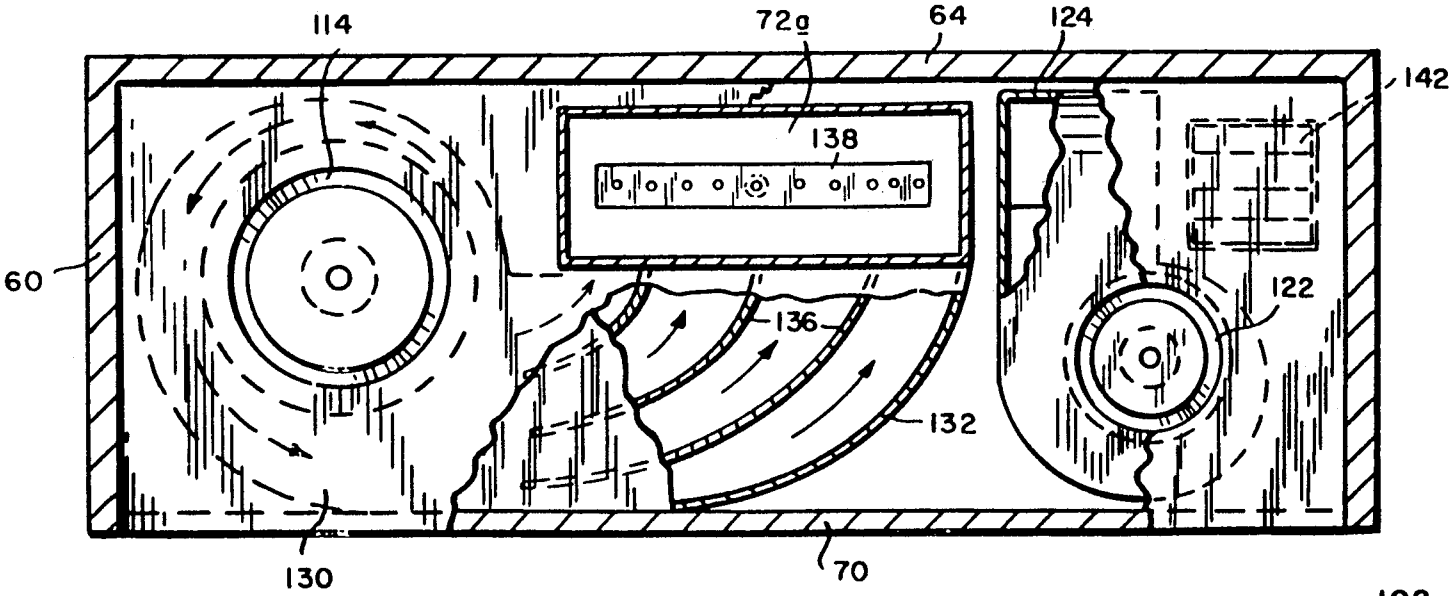
Figure 10:
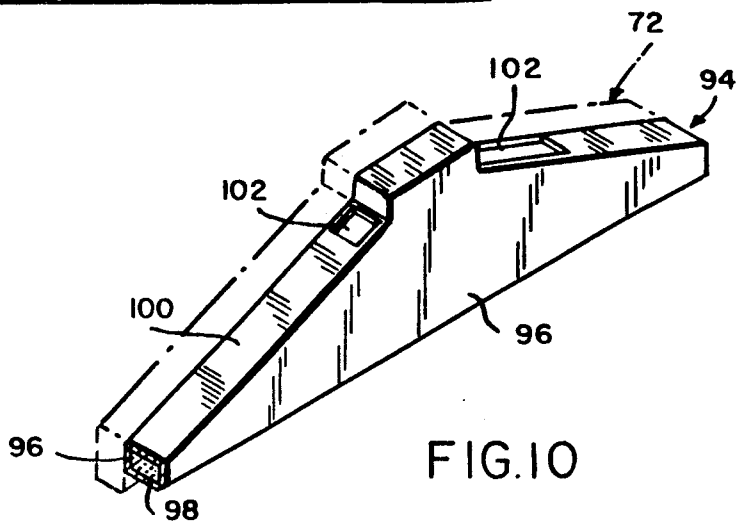
FIG. 10 is a perspective view of a return duct and an adjacent nozzle assembly.
Figure 11:
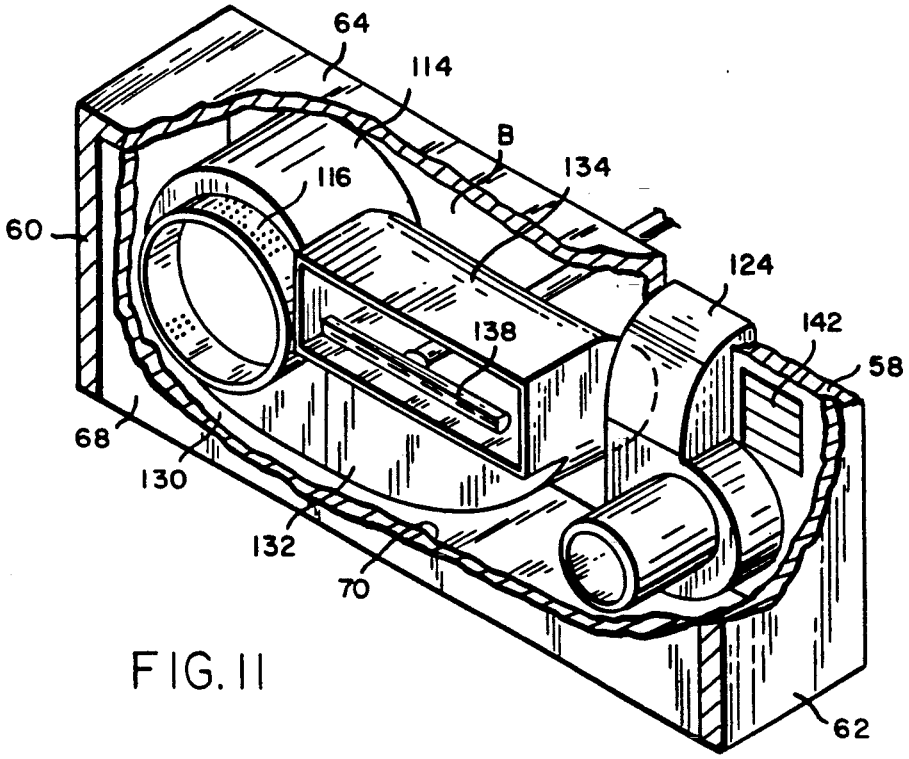
FIG. 11 is a perspective view of components contained in the second chamber of a dryer module.

With reference in particular to FIGS. 7 and 11, it will be seen that the rotational axis of fan 114 is parallel to the length of supply duct 72. Air is drawn by the fan along its axis and is delivered circumferentially to a discharge scroll 130 leading to a diffusing elbow 132. Elbow 132 is designed to efficiently collect and direct the air discharge from fan 114 through a 90° turn before delivering it to a second elbow 134 which effects another 90° turn into the burner chamber 72*a* of supply duct 72. Turning vanes 136 in the diffusing elbow 132 are configured and arranged to equally subdivide the fan discharge, thereby correcting what would otherwise be a non-uniform delivery characteristic of centrifugal fans.

A gas-fed line burner 138 is located in the burner chamber 72*a* of the supply duct 72. The burner 13 8 may be supported by an additional baffle 140 which subdivides the elbow 134 into two flow paths insuring equal amounts of air flow past either side of the burner. Burner 138 provides the energy source required to reheat drying air being recirculated through the system. Pipe stiffeners 141 reinforce the free ends of the baffles 92 and protect them against distortion due to radiant heat from the flame of burner 138.

Make-up air is admitted to the second chamber B via a damper controlled inlet 142. From here, the make-up air is entrained into the system via the perforated duct 116 on the intake side of supply fan 114. Discharge air is removed from the system at a location adjacent to the supply fan inlet port 110 by being drawn into the internal exhaust duct 118 leading to exhaust port 122.

Where two modules 54*a*, 54*b* are employed on opposite sides of the web path P, piston-cylinder units 144 or other like devices may be employed to lift the upper dryer module 54*a* when there is a need to gain access to the dryer interior.

In light of the foregoing, it will now be appreciated by those skilled in the art that the present invention incorporates a number of novel and highly advantageous features. For example, an entire independently operable air system is integrated into each dryer module 54*a*, 54*b*, thereby completely obviating the need for the extensive external ducting, dampers and associated controls required with conventional dryers of the type depicted in FIG. 1. The internal interconnecting air flow passageways are extremely compact, with minimum pressure losses resulting from the use of efficient turns and very short flow distances. This compactness does away with the need for bypass ducting. Velocity and supply balance controls are achieved with variable speed drives 126, 128, thus doing away with conventional dampers. The line-type burner 138 provides good mixing in an extremely compact space with a very short flame, thereby allowing the burner to be placed in a burner chamber 72*a* forming part of the supply duct 72. Heated air is efficiently distributed to the cross-machine center of chamber A at the center of the path P traveled by the web W. The doubly tapered nozzle assemblies 70 further enhance uniform distribution of air to the web while at the same time eliminating the need for intermediate headers of the type shown at 14 in the prior art arrangement of FIG. 1. External flexible connections are also eliminated, except perhaps where required in the exhaust ducting, gas and electrical service leading from the shiftable dryer module 54*a*. Here, however, any degradation of the flexible connection will not be troublesome because resulting debris will simply be exhausted rather than being recirculated through the system. The insulated return ducts 94 prevent shunt losses between the incoming and outgoing air streams, thereby promoting cross-machine uniformity of supply air temperature and web drying rate while also promoting efficiency.

The internal exhaust duct 118 ensures that exhaust flow is collected near the inlet port 110 to the supply fan 114, thereby preventing changes in the rate of exhaust flow from altering the return flow distribution to the nozzle assemblies. Make-up air is uniformly introduced into the system via the perforated duct 116 on the intake side of the supply fan 114.

The downstream location of the burner 138 in relation to the supply fan 114 ensures that the fan is protected from the hazard of receiving poorly mixed flow from the burner with the possibility of overheating the fan.

Figure 2:
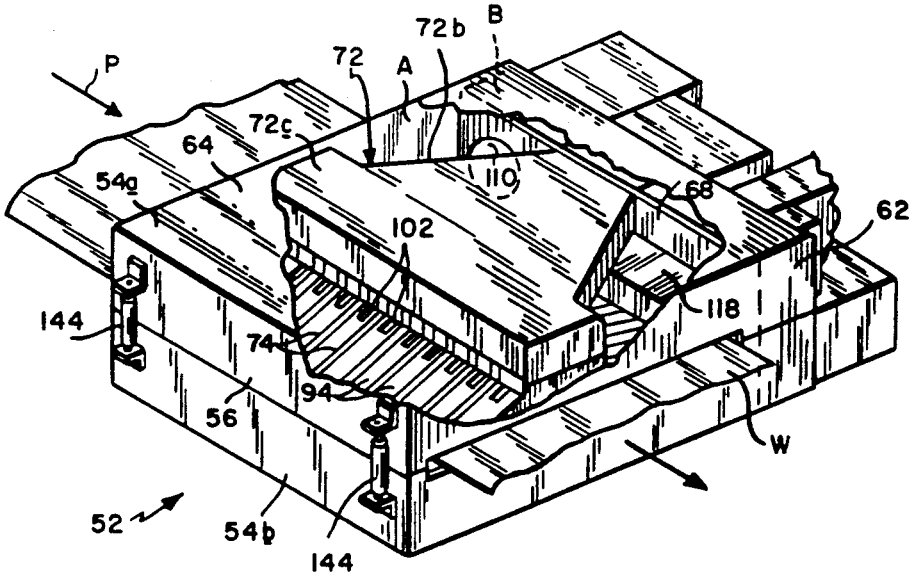
FIG. 2 is a perspective view, again with portions broken away, of a convective dryer in accordance with the present invention.
Figure 3:
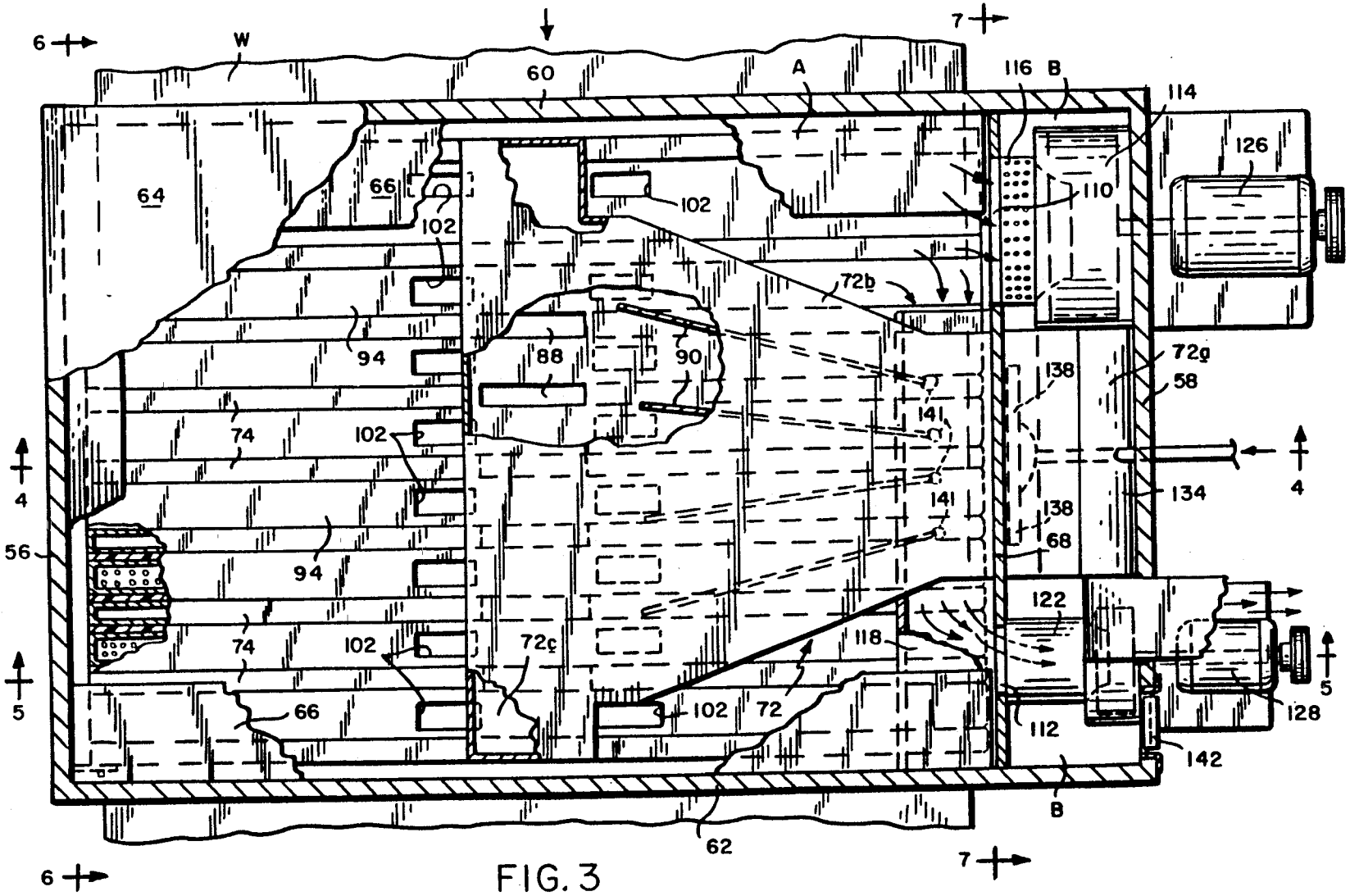
FIG. 3 is a top plan view on an enlarged scale of the dryer shown in FIG. 2, with portions of the top wall and other internal components partially broken away for illustrative purposes.
Figure 5:
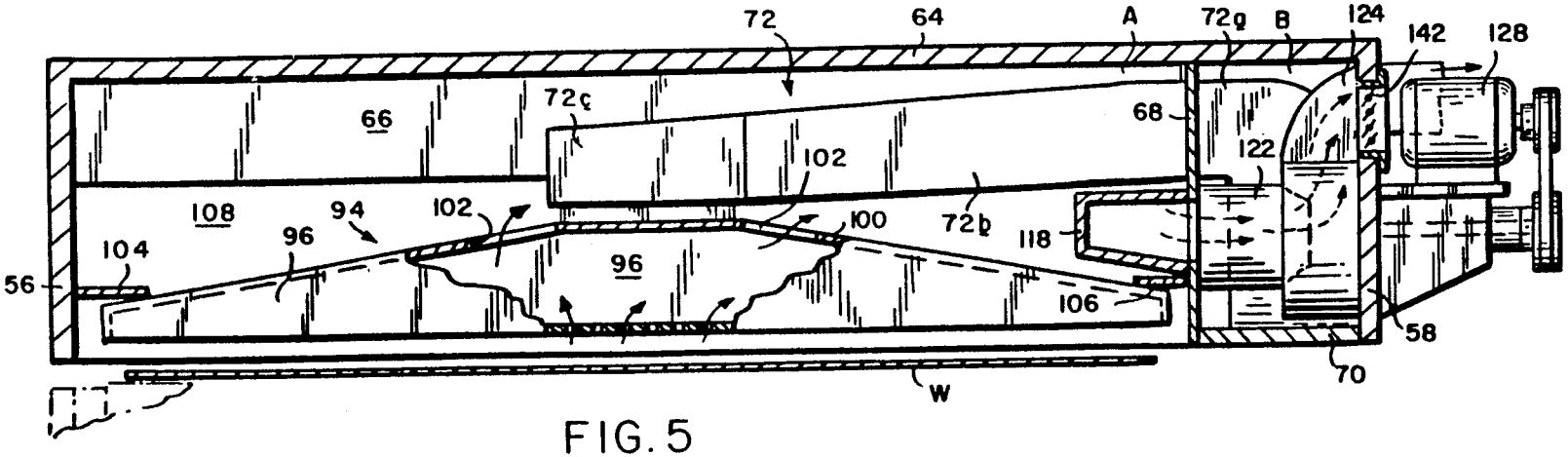
FIGS. 4, 5, 6 and 7 are sectional views on a further enlarged scale taken respectively along lines 4—4, 5—5, 6—6 and 7—7 of FIG. 3.

In the preferred embodiment as shown in FIG. 2, two independently operable modules 54*a*, 54*b* are employed on opposite sides of the web. This arrangement makes it possible to easily vary and control air velocity, temperature and humidity independently on each web side, thereby greatly expanding the controllability of the drying process.

Various changes and modifications may be made to the embodiment described above without departing from the spirit and scope of the invention as hereinafter claimed. For example, alternative heating means other than the disclosed line-type burner 138 may be employed. Such alternative heating means might include steam coils arranged at the same or other locations in the recirculating air flow. Most importantly, however, the heat source should be located sufficiently in advance of the delivery end of the supply duct so as to insure adequate mixing and a substantially uniform elevated temperature before the heated air enters the individual nozzle assemblies.

Other changes might include a repositioning of the exhaust fan 122 to a location other than as illustrated, for example more remote from the dryer module at a location further downstream in the exhaust duct 124.

We claim:

1. A convective dryer for drying a coated web moving along a path, said dryer having at least one equipment module arranged on one side of said path, said module including:

a housing interiorly subdivided into a first chamber opening towards said path and an enclosed second chamber adjacent thereto;

a plurality of mutually spaced nozzle assemblies extending laterally across and spaced along the length of said path within said first chamber, said nozzle assemblies being arranged to direct air against a web moving along said path;

a supply duct gradually diverging in width as measured in directions parallel to said path from a narrow inlet section communicating with said second chamber to a widened delivery end communicating with said nozzle assemblies at the approximate center of said web path;

recirculation means in said second chamber for withdrawing air from said first chamber and for directing the thus withdrawn air in a gradually diverging flow path through said supply duct for reintroduction into said first chamber via said nozzle assemblies; and heater means for heating the air being directed to said supply duct by said recirculation means.

2. The dryer as claimed in claim 1 wherein said supply duct gradually increases in cross-sectional area to a maximum at said delivery end.

3. The dryer as claimed in claim 2 further comprising diffusing means arranged within said supply duct for enhancing the uniformity of distribution of air flowing therethrough to said nozzle assemblies.

4. The dryer as claimed in claim 3 wherein said diffusing means comprises a plurality of mutually spaced baffles defining divergent flow paths.

5. The dryer as claimed in claim 1 wherein said nozzle assemblies comprise elongated manifolds each having at least one orifice connected thereto, said manifolds being connected at the centers thereof to the delivery end of said supply duct.

6. The dryer as claimed in claim 5 wherein said manifolds taper in cross-sectional area in each direction from a maximum at the centers thereof to a minimum at the ends thereof.

7. The dryer as claimed in claim 5 or 6 further comprising second diffusing means arranged within said manifolds for distributing a flow of air received from the delivery end of said supply duct to the respective orifices of said manifolds.

8. The dryer as claimed in claim 7 wherein said second diffusing means comprises a perforated member.

9. The dryer as claimed in claim 8 wherein said perforated member is V-shaped with its maximum dimension being arranged at the point of connection of each manifold to the delivery end of said supply duct.

10. The dryer as claimed in claim 5 further comprising return ducts interposed between said manifolds, said return ducts providing return passages for air being emitted from said orifices.

11. The dryer as claimed in claim 10 wherein said return ducts taper in cross-sectional area in each direction from a maximum at the centers thereof to a minimum at the ends thereof.

12. The dryer as claimed in claim 10 wherein said return ducts cooperate with said nozzle assemblies and said housing to define a return plenum containing said supply duct, said return passages being in communication with said return plenum via outlet openings in said return ducts adjacent to the delivery end of said supply duct.

13. The dryer as claimed in claim 1 wherein said recirculation means includes conduit means in said second chamber, said conduit means having an inlet communicating with said first chamber and having an outlet communicating with said supply duct, and fan means associated with said conduit means for promoting a flow of air therethrough from said first chamber to said supply duct.

14. The dryer as claimed in claim 13 further comprising means for admitting ambient make-up air to said second chamber, and means associated with said conduit means for introducing said make-up air into said conduit means for entrainment with the air flowing therethrough from said return plenum.

15. The dryer as claimed in claim 14 wherein the means for introducing make-up air into said conduit means comprises a perforated conduit section located on the intake side of said fan means.

16. The dryer as claimed in claim 14 wherein said fan means comprises a centrifugal fan having a rotational axis along which air is withdrawn from said return plenum and delivered circumferentially, said rotational axis being parallel to the length of said supply duct, and at least one elbow in said conduit means for directing the circumferentially delivered air from said fan to said supply duct.

17. The dryer as claimed in claim 16 wherein said at least one elbow includes internal diffusing means for uniformly distributing the circumferentially delivered air to said supply duct.

18. The dryer of either claims 16 or 17 wherein said conduit means includes at least one additional elbow.

19. The dryer of claim 13 wherein said heater means is arranged in said supply conduit.

20. The dryer of claim 19 wherein said heater means comprises a line burner.

21. The dryer of claim 13 further comprising exhaust means communicating with said return plenum for exhausting air therefrom.

22. The dryer of claim 21 wherein said conduit means and said exhaust means are connected to said first chamber at adjacent locations on one side of said supply duct.

23. The dryer as claimed in claim 1 wherein two of said modules are arranged in a confronting relationship on opposite sides of a web moving along said path.

24. The dryer as claimed in claim 23 wherein the position of at least one of said modules is adjustable in relation to that of the other of said modules in order to provide access to that portion of said path extending therebetween.

* * * * *